US005505792A

United States Patent [19]

Ouyang et al.

[11] Patent Number: 5,505,792

[45] **Date of Patent: * Apr. 9, 1996**

[54] VISIBLE DRIED-IN-PLACE NON-CHROME POLYACRYLAMIDE BASED TREATMENT FOR ALUMINUM

[75] Inventors: Jiangbo Ouyang, Bensalem; Philip D. Deck, Ardsley; William L. Harpel, Langhorne; Bruce V. Haberle, Fogelsville, all of Pa.

[73] Assignee: Betz Laboratories, Inc., Trevose, Pa.

[ * ] Notice: The portion of the term of this patent subsequent to Mar. 8, 2011, has been disclaimed.

[21] Appl. No.: 166,484

[22] Filed: Dec. 14, 1993

Related U.S. Application Data

[63] Continuation-in-part of Ser. No. 38,592, Mar. 26, 1993, Pat. No. 5,292,378.

[51] Int. Cl.[6] ..... C23C 22/06

[52] U.S. Cl. ..... 148/241; 148/244; 148/251

[58] Field of Search ..... 148/241, 244, 148/251

[56] References Cited

U.S. PATENT DOCUMENTS

| | | | |
|---|---|---|---|
| 3,114,660 | 12/1963 | Cochran | 148/244 |
| 3,326,728 | 6/1967 | Robinson | 148/244 |
| 4,136,073 | 1/1979 | Muro et al. | 260/29.2 |
| 4,921,552 | 5/1990 | Sander et al. | 148/247 |
| 5,158,622 | 10/1992 | Reichgott et al. | 148/247 |
| 5,292,378 | 3/1994 | Ouyang et al. | 148/241 |
| B1 4,191,596 | 6/1990 | Dollman et al. | 148/247 |

FOREIGN PATENT DOCUMENTS 8505131 11/1985 WIPO .

*Primary Examiner*—Sam Silverberg

*Attorney, Agent, or Firm*—Alexander D. Ricci; Steven D. Boyd

[57] ABSTRACT

A method of providing color to a polyacrylamide based, dried-in-place, non-chromate conversion coating is provided. The addition of a phthalo green pigment and optionally a nonionic surfactant to an aqueous, dried-in-place conversion coating treatment solution provides for a colored conversion coating without adversely affecting the corrosion resistance or adhesion properties of the conversion coating.

10 Claims, No Drawings

VISIBLE DRIED-IN-PLACE NON-CHROME POLYACRYLAMIDE BASED TREATMENT FOR ALUMINUM

This application is a continuation-in-part of application Ser. No. 08/38,592 filed Mar. 26, 1993 now U.S. Pat. No. 5,292,378.

FIELD OF THE INVENTION

The present invention relates generally to non-chromate coatings for metals. More particularly, the present invention relates to a visible, siccative, non-chromate coating for aluminum and aluminum alloys. The visible coating of the present invention improves the corrosion resistance and adhesion of paint to the metal surface. The present invention provides a visible dried-in-place coating which is particularly effective at treating aluminum coil, formed aluminum and other metals.

BACKGROUND OF THE INVENTION

The purposes of the formation of a chromate conversion coating on the surface of aluminum are to provide corrosion resistance, improve adhesion of coatings and for aesthetic reasons. The conversion coating improves the adhesion of coating layers such as paints, inks, lacquers and plastic coatings. A chromate conversion coating is typically provided by contacting aluminum with an aqueous composition containing hexavalent or trivalent chromium ions, phosphate ions and fluoride ions. Typical chromium or chromate conversion coatings exhibit a visible coloration ranging from gold to brown.

Growing concerns exist regarding the pollution effects chromate and phosphate discharged into rivers and water ways by such processes. Because of high solubility and the strongly oxidizing character of hexavalent chromium ions, conventional chromate conversion coating processes require extensive waste treatment procedures to control their discharge.

Attempts have been made to produce chromate free conversion coatings for aluminum. Chromate free pretreatment coatings based upon complex fluoacids and polyacrylic acids are known in the art. U.S. Pat. No. 4,191,596 which issued to Dollman et al., discloses a composition for coating aluminum which comprises a polyacrylic acid and $H_2ZrF_6$, $H_2TiF_6$ or $H_2SiF_6$. U.S. Pat. No. 4,921,552 which issued to Sander et al. discloses a nonchromate coating for aluminum which is dried in place which forms a coating having a weight from about 6 to 25 milligrams per square foot. The aqueous coating composition consists essentially of from more than 8 grams per liter $H_2ZrF_6$, more than 10 grams per liter of water soluble acrylic acid and homopolymers thereof and more than 0.17 grams per liter hydrofluoric acid.

U.S. Pat. No. 4,136,073 which issued to Muro et al., discloses a composition and process for the pretreatment of aluminum surfaces using an aqueous acidic bath containing a stable organic film forming polymer and a soluble titanium compound. U.S. Pat. No. 5, 158,622 which issued to Reichgott et al., discloses a dried-in-place conversion coating for metal surfaces such as aluminum and aluminum alloys which employs an aqueous solution of a water soluble maleic or acrylic acid/allyl ether copolymer alone or with an acid.

Most non-chromate based pretreatments generate transparent coatings on metal surfaces. In the use of such pretreatments, the lack of a visible effect such as the color change common in chromate pretreatments makes it virtually impossible to visually verify the presence of a conversion coating. With the prior art chromate pretreatments, it was possible to not only quickly verify visually the presence of the conversion coating, but to also estimate the coating weight by the intensity of the color.

In the treatment of a fast moving coil of metal, visual verification can be very important. With a clear coating, the line must be stopped and a section of metal cut out for testing just to verify the existence of the conversion coating. With the present invention, the color change provides a quick visual verification of the presence of the conversion coating. Prior to the present invention, no methods existed to effectively impart color to a dried-in-place non-chromate polyacrylamide based conversion coating without anodizing the metal surface.

SUMMARY OF THE INVENTION

The present invention provides a method of imparting color to a dried-in-place non-chromate polyacrylamide based conversion coating. The method of the present invention involves the addition of a color imparting agent to a dried-in-place non-chromate based conversion coating. The color imparting agent of the present invention does not adversely affect the corrosion resistance or adhesion properties of the conversion coating. Further, the coloration provided, while visible, does not "bleed through" subsequently applied coating such as paints or lacquers. The method of the present invention imparts color to an unanodized aluminum or aluminum alloy surface while maintaining the adhesion and corrosion resistance of the conversion coating being applied. The method of the present invention involves the addition of a phthalo green pigment to a dried-in-place conversion coating treatment.

As used herein, the term aluminum refers to aluminum as well as alloys of aluminum. In addition, it is believed that the method of the present invention would be similarly effective in the treatment of other metals, galvanized metal and Galvalume®. Galvalume is a registered trademark of Bethlehem Steel Corporation for a zinc-aluminum galvanized steel.

DESCRIPTION OF THE PREFERRED EMBODIMENTS

The present inventors have discovered that color can be imparted to a dried-in-place non-chromate polyacrylamide based conversion coating for aluminum without anodizing. The color is provided by adding a phthalo green pigment to a dried-in-place treatment solution and mixing in order to form a color imparting pretreatment solution. When applied to aluminum or aluminum alloy surfaces and allowed to dry in place, the color imparting pretreatment solution of the present invention provides a color to the conversion coating. The addition of a phthalo green pigment has been found to impart a visible color to the conversion coating without adversely affecting the adhesion properties or corrosion resistance provided by the conversion coating.

The color imparting agent added to the conversion coating treatment is a phthalo green. Phthalo green is a chlorinated copper phthalocyanine or Pigment Green 7. The present inventors found that phthalo green would impart a uniform green color to a dried-in-place conversion coating. The green color was provided without any adverse effects on the adhesion properties or corrosion resistance of the conversion coating. This feature of the phthalo green was unexpected in that many other pigments, including other phthalocyanine pigments, were tested and found to be detrimental to either the adhesion properties or corrosion resistance of the conversion coating.

The phthalo green employed in accordance with the present invention is typically added to a dried-in-place conversion coating treatment solution in concentrations of from about 0.1 to 0.5% by weight. Depending upon the specific dried-in-place pretreatment solution being employed, there may be upper limits to the concentration of phthalo green which may be used. Such upper limits would be determined by a finding of detrimental effects on the paint adhesion and corrosion resistance as determined by conventional test procedures. Typically, the application of a pigmented dried-in-place conversion coating takes place at temperatures ranging from ambient i.e., 21° to 30° C.

The present inventors found that the addition of a nonionic surfactant in combination with the phthalo green pigment provided for a more uniform coloring. Also, the addition of a nonionic surfactant was found to improve the adhesion properties and corrosion resistance of the resulting pigmented dried-in-place conversion coating. Nonionic surfactants found to be effective included Triton X-100 available from Union Carbide and Surfonic N-95 available from Jefferson Chemical Company. It is believed that other nonionic surfactants having similar structures and physical properties would also be effective.

The present invention will now be further described with reference to a number of specific examples which are to be regarded solely as illustrative and not as restricting the scope of the present invention.

In these examples, the effects of the pigment on adhesion properties and corrosion resistance were evaluated with a variety of tests familiar to those skilled in the art. These tests included: "T-bend": the tendency for paint to disadhere from a 180° bend in the metal (OT=perfect); "wedge bend": the amount of paint (in millimeters) lost from the surface above a minimum radius of curvature of a bend in the metal. The bend is formed by first turning the painted metal through a radius about 0.5 centimeters and then flattening an end of the bend to a zero radius; "reverse impact": the tendency for paint to disadhere from a reverse impact metal (OT=perfect); "T-bend/Boiling DI water": the tendency for paint to crack and flower at a 180° bend in the metal after boiling in DI water for 20 minutes. No paint cracking or flowering is considered as Pass; "reverse impact/boiling DI water": the tendency for paint to disadhere from a reverse impacted metal after boiling in DI water for 20 minutes; "cross-hatch/reverse impact": the tendency of paint to disadhere from areas between closely spaced lines through the paint, scribed prior to reverse impact, the test may be done dry or following boiling water treatment (10=a perfect rating); "acetic acid salts spray": per ASTM-B-287 (10=a perfect rating).

While this treatment solution is typically dried in place, treated surfaces may be rinsed.

In example 1–3, a variety of dried-in-place conversion coating treatment solutions were employed. Treatment 1 was a chromic acid base conversion coating solution, employed as a control, available as Permatreat 1500. Treatment 2 was a polyacrylamide based, non-chrome conversion coating solution available as Betz DC-2062. Treatment 3 was a polyacrylamide based, non-chrome conversion coating solution which included Triton X-100 and an ammonium fluorotitanate coating weight tracer available as Betz DC-2104. Treatments 1–3 were colorless when applied to aluminum substrates in the absence of the phthalo green pigment of the present invention. Treatments 1–3 are available from Betz Laboratories, Inc. of Trevose, Pa.

EXAMPLE 1

Several coloring agents other than phthalo green were tested as additives to treatment 2 and 3 and applied to an aluminum substrate. A variety of problems were experienced, including: no obvious coloring effects and non-uniformity. Table 1 summarizes the results of testing on Q-panel alloy 3003 aluminum.

TABLE 1

| Treatment* | Coloring Agent** | Results |
|---|---|---|
| 2 | Rhodamine B | Dense spotting and speckles |
| 2 | Wool violet dye | Non-uniform coloring |
| 2 | Blue black dye | Little coloring effect |
| 2 | phthalo green | Uniform green color |
| 3 | phthalo green | Uniform Green color |

*Treatment concentration 10%
**1.5 grams per liter

EXAMPLE 2

To test bleed through of the phthalo green coloring of the present invention, Treatment 3 with 0.3% phthalo green was applied to Q-panel alloy 3003 aluminum test panels after cleaning with a commercial alkaline cleaner, rinsing and squeegeeing. Five commercial paints were applied using draw-down bar and cured according to the paint manufacturer's specifications except at half the specified paint thickness. There was a greenish tint to the paints due to the paint thickness but no penetration of the phthalo green through the paints was observed.

EXAMPLE 3

Q-panel alloy 3003 aluminum test panels were treated with a commercial alkaline cleaner, rinsed, squeegeed and Treatments 2 or 3 including phthalo green and Triton X-100 were applied in a laboratory spin coater. After spinning to a thin film, the treatment solution was dried in place using a stream of hot air. Comparisons were made between Treatments 2 and 3 with and without phthalo green/Triton X-100. Treatments 2 and 3 were invisible while addition of phthalo green/Triton X-100 provided a uniform green color to the treated metal surface. Two different paint systems were applied by drawn-down rod, and cured in accordance with the manufacturer's specifications. No bleed through was observed in any of these tests. Table 2 summarizes the results.

TABLE 2

| Treatment | Phthalo Green Addition | T-Bend | TB/BW[a] | RI[b] | RI/BW[c] | AASS[d] Scribe | (500 Hrs) Field |
|---|---|---|---|---|---|---|---|
| | | | Paint A | | | | |
| 15% 1 | N | 2T | PASS | 10 | 9 | 10 | 9.5 |
| 10% 2 | N | 1T | PASS | 10 | 9 | 10 | 9.5 |
| 10% 2 | Y* | 1T | PASS | 10 | 9 | 10 | 9.5 |
| 10% 3 | N | 1T | PASS | 10 | 9 | 10 | 9.5 |
| 10% 3 | Y* | 1T | PASS | 10 | 9 | 10 | 9.5 |
| | | | Paint B | | | | |
| 15% 1 | N | 1T | PASS | 10 | 9.5 | 10 | 9 |
| 10% 2 | N | 1T | PASS | 10 | 4 | 10 | 9 |
| 10% 2 | Y* | 1T | PASS | 10 | 6 | 10 | 9 |

TABLE 2-continued

| Treatment | Phthalo Green Addition | T-Bend | TB/BW[a] | RI[b] | RI/BW[c] | AASS[d] Scribe | (500 Hrs) Field |
|---|---|---|---|---|---|---|---|
| 10% 3 | N | 1T | PASS | 10 | 8 | 10 | 9 |
| 10% 3 | Y* | 1T | PASS | 10 | 9 | 10 | 9 |

*0.15% phthalo green plus 0.15% Triton X-100.
Note: Paint A, Akzo water based primer, Akzo polyester topcoat; Paint B, Lilly polyester single coat.
[a]T-bend/Boiling DI water.
[b]Reverse impact.
[c]Reverse impact/Boiling DI water
[d]Acetic acid salt spray While the present invention has been described with respect to particular embodiments thereof, it is apparent that numerous other forms and modifications of the invention will be obvious to those skilled in the art. The appended claims in this invention generally should be construed to cover all such obvious forms and modifications which are within the true scope and spirit of the present invention.

We claim:

1. A method of imparting color to a dried-in-place, non-chromate, polyacrylamide based conversion coating formed on an aluminum or an aluminum alloy surface through contact with the conversion coating treatment solution comprising adding a phthalo green pigment to said conversion coating treatment solution prior to said contact, thereby forming a conversion coating which is visible but does not bleed through a subsequently applied coating.

2. The method of claim 1 further including adding a nonionic surfactant to said conversion coating treatment solution prior to contact.

3. The method of claim 2 wherein the ratio of pigment to surfactant is about 1 to 1.

4. The method of claim 1 wherein the concentration of the pigment in said conversion coating treatment solution is from about 0.1 to about 1.0%.

5. The method of claim 1 wherein said dried-in-place, polyacrylamide, non-chromate conversion coating further includes fluorotitanate salts or acid.

6. A method of imparting color to a dried-in-place, non-chromate, polyacrylamide based conversion coating formed on a metal surface through contact with a conversion coating treatment solution comprising adding a phthalo green pigment to said conversion coating treatment solution prior to said contact, thereby forming a conversion coating which is visible but does not bleed through a subsequently applied coating.

7. The method of claim 6 further including adding a nonionic surfactant to said conversion coating treatment solution prior to contact.

8. The method of claim 7 wherein the ratio of pigment to surfactant is about 1 to 1.

9. The method of claim 6 wherein the concentration of the pigment in said conversion coating treatment solution is from about 0.1 to about 1.0%.

10. The method of claim 6 wherein said dried-in-pace, polyacrylamide, non-chromate conversion coating further includes fluorotitanate salts or acid.

* * * * *